US006370745B1

(12) United States Patent
Kele et al.

(10) Patent No.: US 6,370,745 B1
(45) Date of Patent: Apr. 16, 2002

(54) CRYPT SYSTEM

(75) Inventors: Gavin William Kele; Michael Drew Wickerson; Thomas Allen Wyatt; Laurence Edwin Georgeson, all of Rockhampton (AU)

(73) Assignee: Rockhampton City Council (AU)

( * ) Notice: Subject to any disclaimer, the term of this patent is extended or adjusted under 35 U.S.C. 154(b) by 0 days.

(21) Appl. No.: 09/117,016

(22) PCT Filed: Jan. 21, 1997

(86) PCT No.: PCT/AU97/00032

§ 371 Date: Jul. 21, 1998

§ 102(e) Date: Jul. 21, 1998

(87) PCT Pub. No.: WO97/27375

PCT Pub. Date: Jul. 31, 1997

(30) Foreign Application Priority Data

Jan. 22, 1996 (AU) ..... PN7653

(51) Int. Cl.[7] ..... A61G 17/00
(52) U.S. Cl. ..... 27/35; 52/136
(58) Field of Search ..... 27/35, 1; 52/128, 52/135, 136, 137, 139, 134; D99/1

(56) References Cited

U.S. PATENT DOCUMENTS

| | | | | | |
|---|---|---|---|---|---|
| 2,835,955 A | * | 5/1958 | Snyder | 27/17 |
| 3,295,271 A | * | 1/1967 | Dorris | 52/137 X |
| 3,897,663 A | * | 8/1975 | Gaul | 52/136 |
| 4,134,239 A | | 1/1979 | Obonaga-Calle | 52/133 |
| 5,287,603 A | * | 2/1994 | Schorman | 27/35 X |
| 5,381,591 A | | 1/1995 | Ponger et al. | 27/35 |
| 5,511,345 A | | 4/1996 | Jones et al. | 52/136 |

FOREIGN PATENT DOCUMENTS

| | | | | |
|---|---|---|---|---|
| FR | 2.186.051 | | 1/1974 | |
| FR | 2.225.993 | | 11/1974 | |
| FR | 2444770 | * | 8/1980 | 52/134 |
| FR | 2.719.071 | | 10/1995 | |
| WO | WO 95/31624 | | 11/1995 | |

* cited by examiner

*Primary Examiner*—Brian K. Green
(74) *Attorney, Agent, or Firm*—Patton Boggs LLP

(57) ABSTRACT

A burial crypt arrangement comprises precast concrete cells (1) arranged in rows, with the cells (1) in each row being spaced apart and staggered relative to the cells (1) in adjacent rows. The corners (3) of cells (1) in a row are juxtaposed with the diagonally opposite corners of cells in adjacent rows. In this manner, both the spaces within cells, and the spaces between cells, can be used as burial chambers. Each cell (1) is formed by a continuous wall (2) of rectangular shape. Cells may be stacked vertically. The thickness of the wall (2) is tapered, being thicker at the top than the bottom, so that a ledge (9) is formed at the junction of stacked cells. An intermediate lid (10) can be supported in each burial chamber by the ledges (9). Each burial chamber is closed by a top lid (12). A trailer (17) can be used to raise and transport the lids (12).

13 Claims, 4 Drawing Sheets

CRYPT SYSTEM

This invention relates to burial crypts. In particular, the invention is directed to an improved crypt, and a crypt arrangement which provides a more efficient system of burial.

BACKGROUND OF THE INVENTION

The traditional method of burial requires excavation of individual grave sites, replacement of the excavated soil on top of the coffin, and subsequent landscaping. The traditional burial technique is not only labour intensive, but also wasteful of space.

Various modular burial structures have been proposed in order to overcome the disadvantages of traditional burial techniques. Examples of such modular burial systems can be found in international patent application no. PCT/AU95/00272 (WO 95/31623); Australian patent application no. 30423/92 and U.S. Pat. Nos. 3,878,656, 4,068,425, 4,606,839, 4,989,382, 5,243,794 and 5,381,591. However, in these systems the modules are stacked vertically to form mausoleums. According to some cultures and religions, deceased persons should be buried in graves below ground, rather than aboveground in mausoleums.

U.S. Pat. No. 4,134,239 describes a burial field arrangement comprising rows of rectangular burial chambers formed from individual wall sections. Although the burial system of U.S. Pat. No. 4,134,239 permits in-ground burial and provides an efficient use of space, its construction is particularly time consuming as the chambers must be formed from many individual components.

It is an object of this invention to provide an improved crypt, and a more efficient and economic crypt arrangement.

SUMMARY OF THE INVENTION

In one broad form, this invention provides a crypt arrangement for a cemetery, comprising at least one layer of hollow cells arranged in rows, each cell being formed by a continuous wall of generally rectangular shape when viewed from above, the cells in each row being spaced apart and staggered relative to cells in adjacent rows, with cells in a row having their corners juxtaposed with the diagonally opposite corners of cells in adjacent rows, whereby burial crypts are formed by the spaces within cells and the spaces between cells.

Throughout this specification, the term "cell" is intended to mean a structural unit comprising an area or volume bounded by the wall. Typically, each cell is constructed of concrete.

In the preferred embodiment, the cells are of identical construction, and are arranged so that the spaces within the cells are generally of the same shape and volume as the spaces between the cells. In this manner, an efficient crypt arrangement is obtained, in which there are approximately twice as many burial crypts as cells, the crypts being separated by a single wall thickness.

Preferably, the corners of the rectangular cells have outer faces which are angled obliquely to the sides of the cells. The oblique outer face of a cell corner is wholly within a notional rectangular boundary defined by the outer faces of the side walls of the cell. When the cells are arranged to form the cemetery, the outer oblique face of a corner of a cell is juxtaposed with the outer face of a diagonally opposite corner of an adjacent cell. Each outer face may contain a vertical groove so that a composite bore is formed by opposed grooves in juxtaposed faces. The bore can be filled with grout or other sealant to seal the junction between cells.

Preferably, the wall on at least one pair of opposed sides of the cell is of tapered thickness, being thicker at its top than its bottom.

The crypt arrangement may be formed from two (or more) layers of cells, with each cell in an upper layer being stacked on a respective cell in the layer below. Due to the tapered wall thickness, a ledge is formed at the junction of vertically stacked cells, the ledge being formed both inside and outside the cell wall. Intermediate lids may be supported on such ledges within any of the burial crypts.

The tops of the cells in the upper layer, and the tops of the spaces between cells in the upper layer, can be closed by respective lids. The lids, and the intermediate lids, can be formed of several sections.

This invention also provides a vehicle for raising and transporting a lid of a crypt, the vehicle being adapted to be positioned over the crypt and comprising a mobile frame supported on spaced ground-engaging elements, attachment means for connection to the lid, the attachment means being located within the frame, and powered lifting means for raising the attachment means within the frame.

Typically, the vehicle is a wheeled trailer, and the attachment means comprises a horizontal frame which is shaped and dimensioned to match approximately the periphery of the lid to be raised. The vehicle is able to lift the lid together with any soil and turf on the lid. Similarly, the lid, soil and turf can be replaced together in a single operation, thereby minimising the time required to open and close a crypt.

In order that the invention may be more fully understood, a preferred embodiment will now be described with reference to the accompanying drawings.

DESCRIPTION OF THE PREFERRED EMBODIMENT

Figure 1:
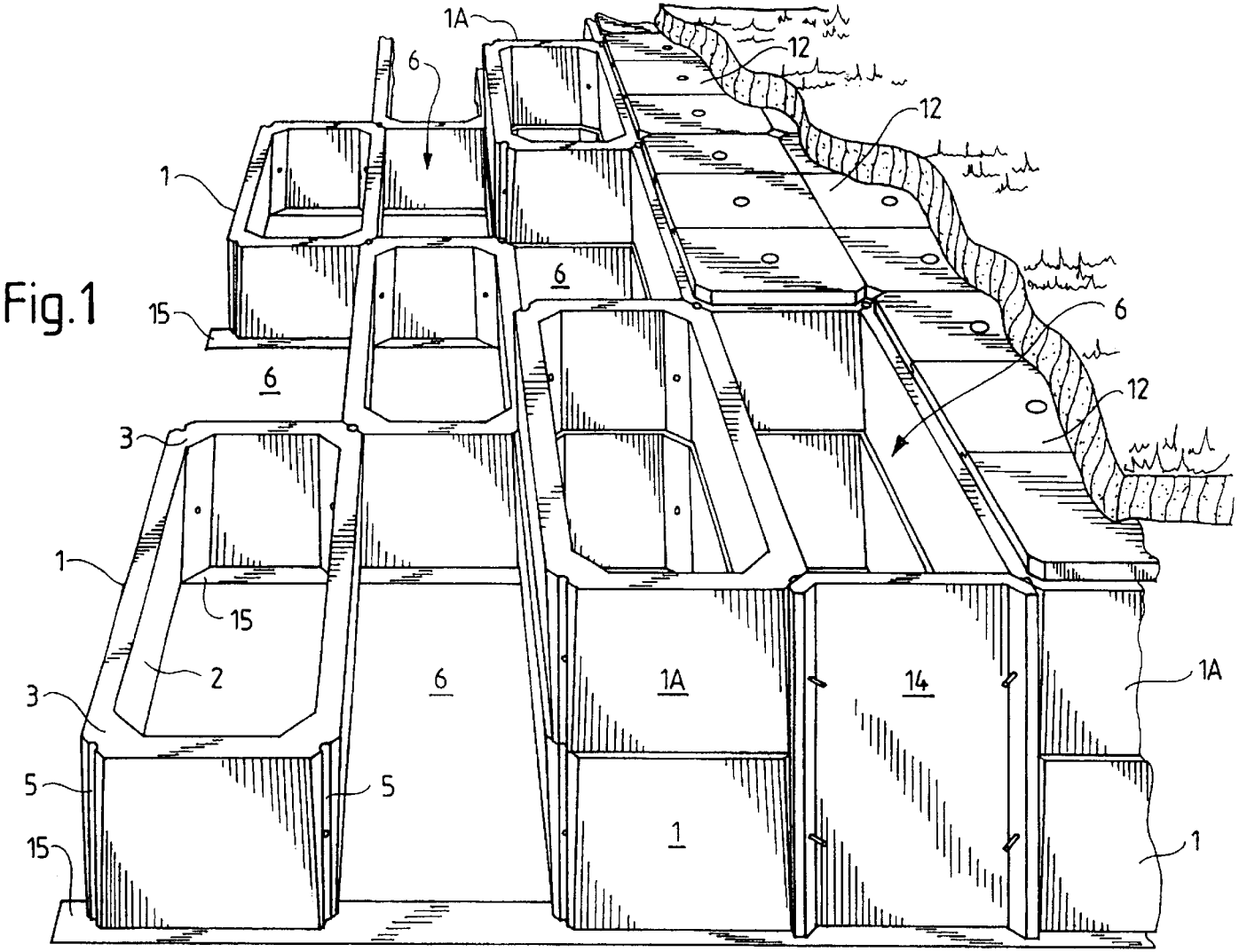
FIG. 1 is a fragmentary perspective view of a partially completed crypt arrangement.

As shown in the drawings, a burial crypt system is formed from an arrangement of precast concrete "cells" 1 which are substantially identical in shape. Each cell 1 is formed by a continuous perimeter wall 2 which is generally of rectangular shape (in plan) comprising two pairs of parallel side walls. Each cell 1 is open at its top and bottom.

Figure 2:
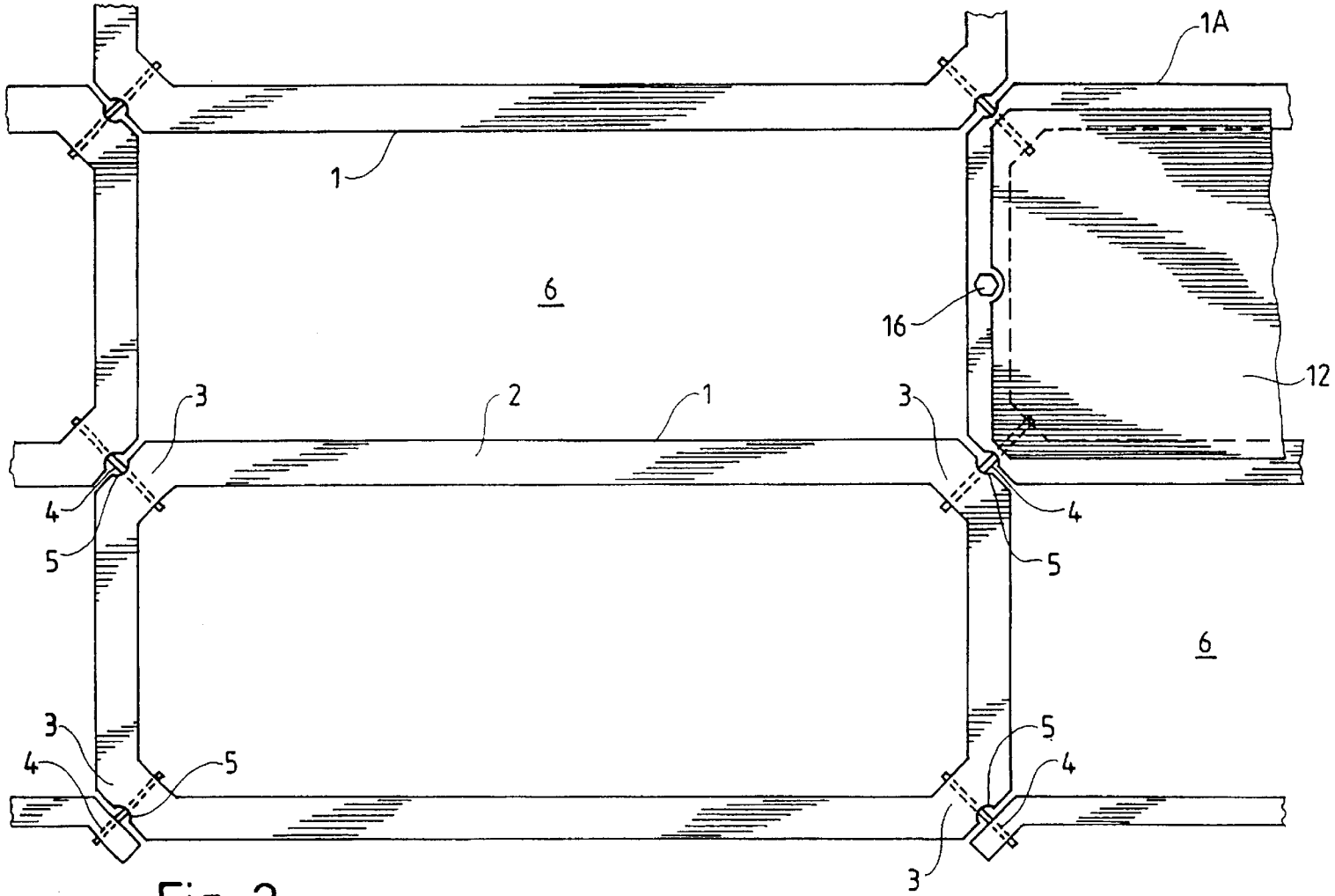
FIG. 2 is a fragmentary plan view of the crypt arrangement.

The corners 3 of the cells 1 are truncated and have oblique outer faces which are juxtaposed with (and may abut) the oblique outer faces of the diagonally opposite corners of cells in adjacent rows, as shown in FIG. 2. The juxtaposed corners 3 may be held together by fastening means, such as bolts 4 inserted through aligned horizontal bolt holes in the corners of the cells.

A vertical channel 5 is formed along the oblique outer face of each corner region 3. Grout or other sealing material can be inserted in the composite bore formed by opposed channels in juxtaposed corner regions, to seal the corner junctions of the cells 1.

In the crypt arrangement of the preferred embodiment, the rectangular crypt cells 1 are arranged in rows. The cells in each row are spaced apart, and staggered or offset relative to the cells in adjacent rows. The truncated corners of cells in one row abut the truncated corners of offset cells in adjacent rows.

The interstitial spaces 6 formed between the spaced cells 1 are of substantially the same shape and volume as the chamber within each cell 1. The cells 1, and the interstitial spaces 6 between the cells, each form a chamber or crypt suitable for burial. Thus, for a particular number of cells, the described arrangement enables approximately twice as many burial chambers to be obtained.

The cells 1 may be arranged in a single layer, with each cell having a height equal to the desired depth of the crypt. Preferably however, the cells are of shorter height and are stacked vertically, typically in two or three layers, to achieve the desired depth. As shown in FIG. 1, a second layer of cells 1A is placed over the first layer of cells 1, with each cell 1A being positioned on a respective cell 1 to form a composite crypt.

The shorter cells are easier to construct, transport and handle. Vertical stacking of the cells also enables a crypt to accommodate multiple burials, one above the other, as described below.

Figures 3, 4:
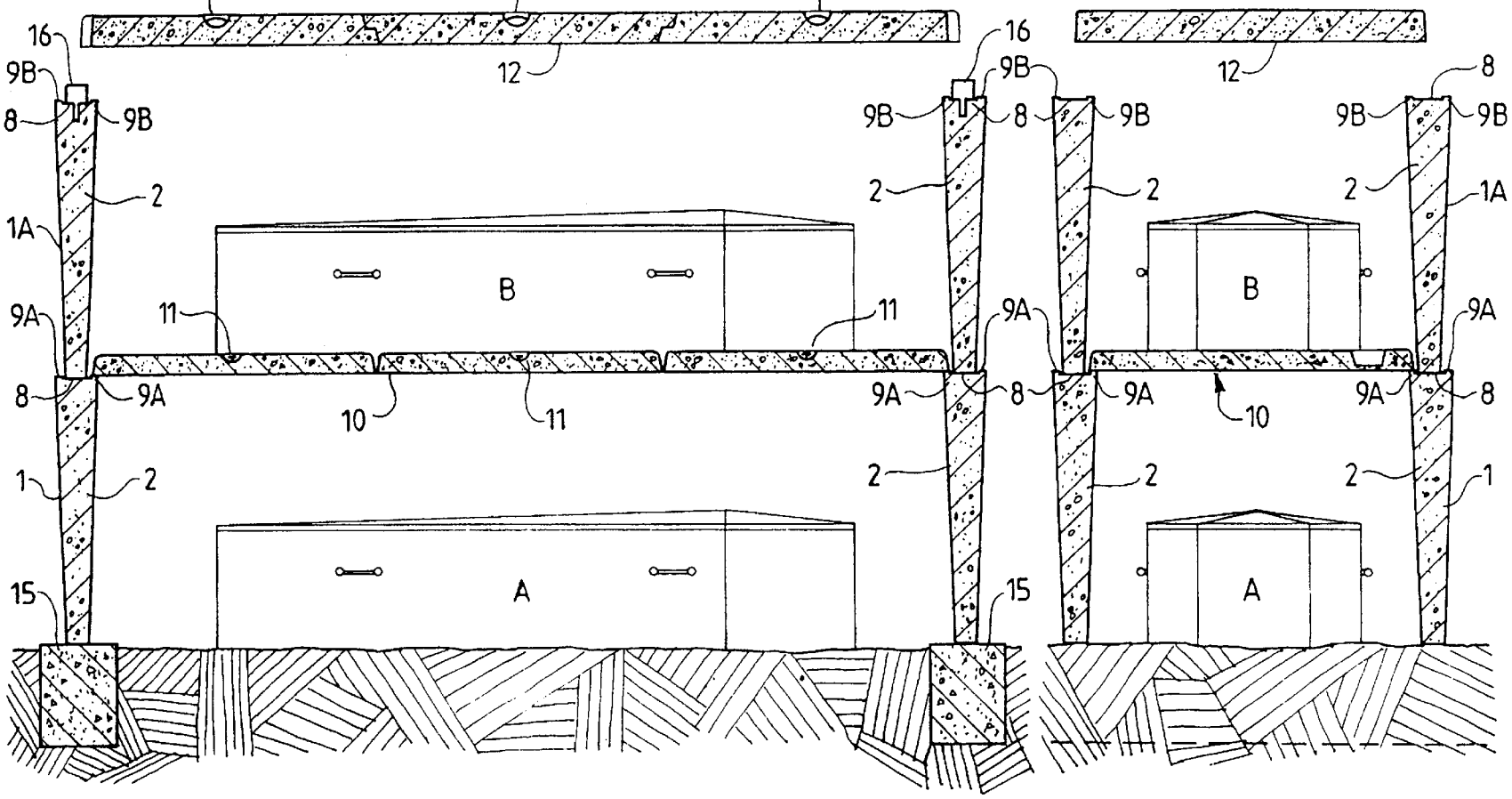
FIG. 3 is a sectional side elevation of part of the crypt arrangement.
FIG. 4 is a sectional end elevation of part of the crypt arrangement.

As shown in FIGS. 2 and 3, the side walls 2 of each cell are of tapered thickness, with the lower end being narrower than the upper end. A shallow longitudinal channel 8 is formed along the top of the perimeter wall 2. The width of the channel 8 is slightly larger than the width of the bottom end of the perimeter wall. When one cell is stacked upon another cell, the lower ends of the side walls 2 of the upper cell locate in the channels 8 formed in the upper ends of the subjacent cell, as shown in FIGS. 2 and 3. Since the bottom of the upper cell locates in the channel 8 in the top of the bottom cell, the joint between the two cells is sealed. Additional sealing can be obtained by placing a sealing compound or other deformable material in the joint between the upper and lower cells.

Since the top end of the side wall of the lower cell 1 is wider than the bottom end of the side wall of the upper cell 1A, a ledge or shoulder 9A is formed on either side of the junction of a pair of stacked cells. An intermediate concrete lid 10 can be supported at its periphery on the ledges 9A. The intermediate lids 10 can be placed within the crypts formed by stacked cells, and within the crypt formed by the space 6 between adjacent cells. Each intermediate lid 10 preferably comprises three sections which are separately removable. Each section has an attachment fitting 11 on its upper surface.

Ledges or shoulders 9B are also formed along both sides of the top end of the upper cell 1A and are used to support top concrete lids 12. Each cell 1A, and each interstitial space 6, can be closed by a respective top lid. Each top lid 12 is of generally rectangular shape, and comprises three sections, the central section being removable independently of the two end sections. Each section is provided with an attachment fitting 13. The lids 12 have shallow lips on the underside of their periphery which locate in the channel 8 in the top cells 1A.

Since the cells in each row are spaced apart, and offset relative to cells in adjacent rows, open chambers will remain at the end of each row and/or column of cells. As shown in FIG. 1, concrete panels 14 are used to close these chambers and complete the rectangular perimeter of the crypt arrangement. Each concrete panel 14 has obliquely angled upright faces at its opposite vertical edges. The obliquely angled faces abut the truncated edges of spaced cell stacks. Bolts 4 may be used to secure the perimeter panels 14 to their abutting cells in the same manner as the cells are joined to each other.

To construct the crypt arrangement, the ground is first cleared and graded to the required depth. Preferably, a slight slope is provided for drainage. Concrete strip footings 15 are then formed in the ground. The strip footings 15 are parallel, and spaced apart by the length of a cell. Rows of precast concrete cells 1 are then placed on the footings 15, the shorter side walls of the cells 1 being supported on the footings 15. Typically, a crane is used to lift the cells and place them in the desired positions. As shown in FIG. 4, the rows form horizontal layers, with the horizontal layers being in a direction substantially parallel to the ground, and thus substantially perpendicular to the earth's gravitational force.

As shown in FIG. 1, the cells in each row are offset or staggered relative to the cells in the preceding row, and the truncated corners of the cells abut the diagonally opposite corners of adjacent cells. Preferably, two layers of cells are used, the cells in the upper layer being stacked on respective cells in the lower layer. However, a greater number of layers may be used.

The end panels 14 are then used to complete the rectangular perimeter of the crypt arrangement. In this manner, the space within each cell stack, and the interstitial space between cells, each form a burial crypt or chamber. The burial chambers are substantially the same dimensions, and are separated by a single cell wall thickness.

After the cells have been positioned, joined together and their joints sealed, the crypt arrangement is completed by placing the top lids 12 on the cells and over the interstitial chambers between the cells. The top end of each cell wall is wide enough to support the edge portions of both the lid over the cell and the lid over the adjacent interstitial space. The top lids 12 are then covered with a layer of soil, typically 200 mm deep. Turf is laid over the soil to form a lawn cemetery.

A headstone may be incorporated on the top lid 12. Preferably however, no headstone is used so that the lawn on top of the crypts is unobstructed. To indicate the position of the subterranean cells, a small marker 16 can be placed on each cell 1A. The marker 16 is a short rod which protrudes upwardly from the top of the cell 1A through the soil, and is surmounted by a cap at turf level but below mowing height. The marker may indicate whether a person is buried in the crypt to which the marker relates.

The intermediate lids 10 are only required if more than one body is to be buried in a particular chamber. Typically, in the first burial, a coffin A (FIG. 2) is placed at the bottom of the crypt in contact with the soil. If it is desired to bury another person in the same crypt before the first body has decomposed, an intermediate lid 10 is placed in the chamber, supported by the ledges 9A formed at the top of the lower cell 1. A second coffin B may then be placed on the intermediate lid 10. If however, sufficient time has passed since the first coffin A was placed in the crypt, soil may be added to the crypt, sufficient to just cover the coffin A. The next coffin may then be placed on the soil. The intermediate lid 10 can then be used to support a third coffin. In this manner, a crypt may accommodate up to four burials, e.g. four members of the same family.

Figure 5:
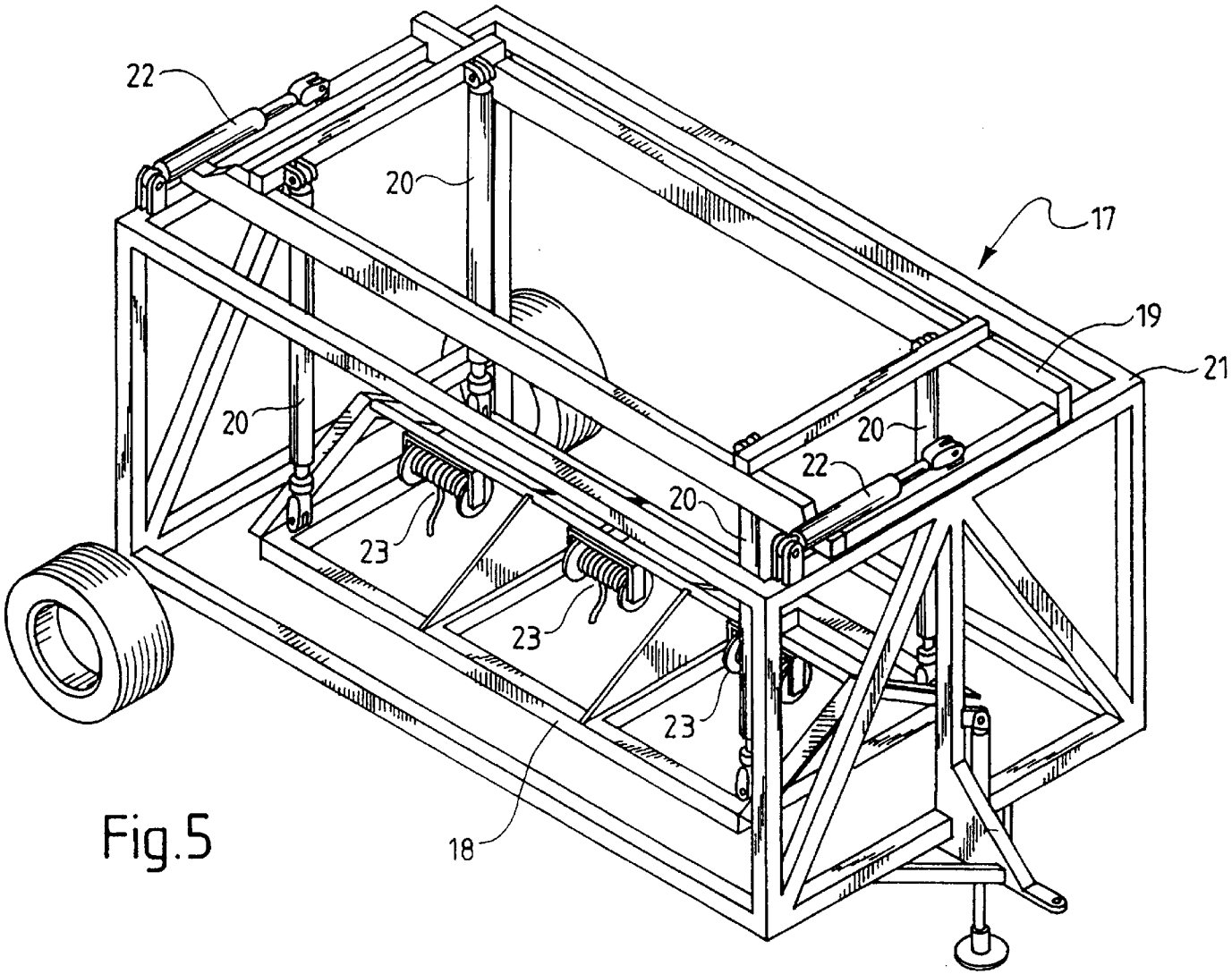
FIG. 5 is a perspective view of apparatus for removing and replacing crypt lids.

FIG. 5 illustrates a trailer 17 suitable for removing and replacing the top lids 12, intermediate lids 10 or sections of the lids. The trailer 17 may be mounted on wheels (as shown), tracks or skids, and is typically towed behind a tractor or similar vehicle.

The trailer 17 comprises a cradle assembly 18 suspended from a sliding frame 19 by four independently controllable hydraulic cylinders 20. The sliding frame 19 can be positioned laterally relative to a main trailer frame 21 by hydraulic cylinders 22. The cradle assembly 18 also includes three winches 23 each having a cable which may be secured to the attachment fitting on a respective lid section. The winches 23 are spaced apart by the same distances as the attachment fittings on the lid sections.

In use, if a body is to be buried in a particular crypt, it is first necessary to remove the crypt lid and covering soil/turf. The particular crypt is located by stringline reference from markers 16 on the end crypts in the rows and columns of the crypt arrangement.

A pair of back-to-back angle sections (not shown) forming a T arrangement are inserted in the soil along the rectangular periphery of the crypt to be opened. The outer angle section defines the edge of the opening in the soil, and is left in place during interment to hold the soil along the edge of the opening. The inner angle section is lifted with the top lid of the crypt and overlying soil, as described below.

A template is placed over the crypt. The template has reference points which align with the crypt markers, as well as three reference circles which define the location of the attachment fittings on the three lid sections. It is therefore only necessary to remove a small amount of soil directly below the reference circles in order to reveal the attachment fittings.

The trailer 17 is then moved into position over the crypt. By moving the trailer back or forth, and operating the hydraulic cylinders 22, the cradle 18 is positioned so that the winches 23 are located precisely over the attachment fittings. The winch lines are then secured to each respective attachment fitting on the lid sections.

The winches 23 are wound to tension the respective winch lines. The three lid sections and the overlying soil and turf, together with the inner angle section are then raised together as the cradle assembly 18 is lifted by the hydraulic cylinders 20. The lid sections may be raised at an angle, since the hydraulic cylinders 20 are able to be controlled independently. This assists in freeing stuck edges or corners of the lid sections.

The trailer is then towed away to enable the burial to take place. After the burial, the top lid, together with the overlying soil and turf, is then replaced in the reverse manner to that described above. Thus, the crypts can be open and closed quickly, with minimum labour requirements and minimum disruption to the overlying turf.

The foregoing describes only one embodiment of the invention, and modifications which are obvious to those skilled in the art may be made thereto without departing from the scope of the invention. For example, each cell may be divided into a number of smaller compartments, each closed by a respective lid section, for burial of pets, cremation ashes, or foetuses. Further, the crypt arrangement of this invention may be used for underground storage of other materials, such as hazardous wastes.

What is claimed is:

1. A crypt arrangement for a cemetery, comprising a plurality of hollow cells arranged in a plurality of horizontal rows in a horizontal layer, said horizontal layer being in a direction substantially perpendicular to the direction of the earth's gravitational force, each row having a plurality of said cells, each cell being formed by a continuous wall of generally rectangular shape, when viewed from above, with vertical corners, characterized in that the cells in each row are spaced apart from other cells in the same row and staggered relative to cells in adjacent rows of the same horizontal layer, with each cell in a row of a horizontal layer having at least one of its vertical corners juxtaposed with the diagonally opposite vertical corner of a cell in an adjacent row of the same horizontal layer, burial crypts being formed by the spaces within cells and the spaces between cells.

2. A crypt arrangement as claimed in claim 1, wherein each of the vertical corners of the cells is truncate and has an outer face which is angled obliquely to the sides of the cell, and wherein the outer face of a corner of a cell is juxtaposed with the outer face of a diagonally opposite corner of an adjacent cell.

3. A crypt arrangement as claimed in claim 2, wherein the juxtaposed corners of adjacent cells are held together by fastening members passing through the juxtaposed outer faces of the corners.

4. A crypt arrangement as claimed in claim 2, wherein each oblique outer face has a vertical groove therein, such that the juxtaposed outer faces of adjacent corners form a composite bore, the bore being filled with cementitious material.

5. A crypt arrangement as claimed in claim 1, wherein the wall on at least one pair of opposed sides of the cell is of tapered thickness, the wall being thicker at its top than its bottom.

6. A crypt arrangement as defined in claim 5, wherein the wall is tapered symmetrically about its central longitudinal vertical plane.

7. A crypt arrangement as claimed in claim 2, further comprising at least one substantially planer perimeter panel adapted to be placed between opposed corners of a pair of spaced cells outermost of the arrangement, and having oblique vertical faces at its opposite ends for abutting respectively against the oblique outer faces of the opposed corners.

8. A crypt arrangement as claimed in claim 1, wherein each cell is of concrete construction with an open top and an open bottom, further comprising a plurality of lids, the tops of the cells, and the tops of the spaces between cells being closed by respective lids.

9. A crypt arrangement as claimed in claim 1, further comprising a second horizontal layer of cells, each cell in the second layer being stacked upon a respective cell in the first layer.

10. A crypt arrangement as claimed in claim 9, wherein the wall on at least one pair of opposed sides of each cell is of tapered thickness, the wall being thicker at its top than at its bottom, such that a ledge is formed at the junction of the cells in the first and second layers.

11. A crypt arrangement as claimed in claim 10, further comprising at least one intermediate lid located within a cell or in the space between cells, and supported at its opposite side edges on the ledges.

12. A crypt arrangement as claimed in claim 9, wherein each cell is of concrete construction with an open top and an open bottom, further comprising a plurality of lids, the tops of the cells in the second layer and the tops of the spaces between cells in the second layer being closed by respective lids.

13. A precast concrete crypt formed as an integrally molded continuous perimeter wall of generally rectangular shape when viewed from above and comprising two pairs of opposed parallel upright side walls with each side wall of a pair being joined to the side walls of the other pair along generally vertical corners of the perimeter wall, the crypt having top and bottom openings defined by the side walls, and wherein the corners of the perimeter wall are truncated and have vertical external faces which are angled obliquely to the side walls, and the side walls are of tapered thickness, being thicker at the top than the bottom.

* * * * *